US009935359B2

(12) United States Patent
Kim et al.

(10) Patent No.: US 9,935,359 B2
(45) Date of Patent: Apr. 3, 2018

(54) ANTENNA AND ELECTRONICS DEVICE INCLUDING THE SAME

(71) Applicant: Samsung Electronics Co., Ltd., Gyeonggi-do (KR)

(72) Inventors: Jae Hyung Kim, Seoul (KR); Jin U Kim, Daejeon (KR); Jin Kyu Bang, Gyeonggi-do (KR); Dong Hwan Kim, Gyeonggi-do (KR); Tae Gyu Kim, Gyeonggi-do (KR); Ki Young Chang, Seoul (KR); Sung Yeul Hong, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/180,890

(22) Filed: Jun. 13, 2016

(65) Prior Publication Data

US 2016/0365623 A1 Dec. 15, 2016

(30) Foreign Application Priority Data

Jun. 11, 2015 (KR) ..... 10-2015-0082840

(51) Int. Cl.
*H01Q 1/24* (2006.01)
*H01Q 1/52* (2006.01)
(Continued)

(52) U.S. Cl.
CPC ..... *H01Q 1/243* (2013.01); *H01Q 1/38* (2013.01); *H01Q 1/48* (2013.01); *H01Q 1/50* (2013.01);
(Continued)

(58) Field of Classification Search
CPC ..... H01Q 1/243; H01Q 1/38; H01Q 1/50; H01Q 1/521; H01Q 5/328; H01Q 5/371;
(Continued)

(56) References Cited

U.S. PATENT DOCUMENTS 7,612,725 B2 11/2009 Hill et al.
2006/0097918 A1 5/2006 Oshiyama et al.
(Continued)

FOREIGN PATENT DOCUMENTS

CN 104577334 4/2015
KR 10-2013-0102170 9/2013

OTHER PUBLICATIONS

European Search Report dated Nov. 10, 2016 issued in counterpart application No. 16173723.4-1811, 10 pages.

*Primary Examiner* — Hoang Nguyen
(74) *Attorney, Agent, or Firm* — The Farrell Law Firm, P.C.

(57) ABSTRACT

An electronic device including a plurality of antennas is provided. The electronic device includes a first radiator including at least one matching block that is connected with a ground area and at least one side of the first radiator. The first radiator is configured to transmit and receive a first frequency signal through a first antenna resonance length corresponding to a first area of the first radiator, and to transmit and receive a second frequency signal through a second antenna resonance length corresponding to a second area opposite to the first area. A second radiator is connected with the ground area and is configured to transmit and receive a third frequency signal through a third antenna resonance length corresponding to a third area adjacent to the first radiator.

20 Claims, 19 Drawing Sheets

(51) Int. Cl.

| | |
|---|---|
| ***H01Q 9/42*** | (2006.01) |
| ***H01Q 21/28*** | (2006.01) |
| ***H01Q 5/328*** | (2015.01) |
| ***H01Q 1/38*** | (2006.01) |
| ***H01Q 1/48*** | (2006.01) |
| ***H01Q 1/50*** | (2006.01) |
| *H01Q 5/371* | (2015.01) |
| *H01Q 5/378* | (2015.01) |

(52) U.S. Cl.
CPC ..... *H01Q 1/521* (2013.01); *H01Q 5/328* (2015.01); *H01Q 9/42* (2013.01); *H01Q 21/28* (2013.01); *H01Q 5/371* (2015.01); *H01Q 5/378* (2015.01)

(58) Field of Classification Search
CPC ..... H01Q 5/378; H01Q 9/42; H01Q 21/28; H01Q 1/24
See application file for complete search history.

(56) References Cited

U.S. PATENT DOCUMENTS

| | | | |
|---|---|---|---|
| 2008/0316115 | A1 | 12/2008 | Hill et al. |
| 2012/0299785 | A1 | 11/2012 | Bevelacqua |
| 2013/0234911 | A1 | 9/2013 | Lee |
| 2014/0361941 | A1 | 12/2014 | Jenwatanavet et al. |
| 2016/0233574 | A1 | 8/2016 | Xiong et al. |

ANTENNA AND ELECTRONICS DEVICE INCLUDING THE SAME

PRIORITY

This application claims priority under 35 U.S.C. § 119(a) to Korean Patent Application Serial number 10-2015-0082840, which was filed on Jun. 11, 2015 in the Korean Intellectual Property Office, the entire disclosure of which is incorporated herein by reference.

BACKGROUND

1. Field of the Disclosure

The present disclosure relates generally to an antenna, and more particularly, to an electronic device that includes an antenna having at least one matching block which connects with a ground area and with a side of at least one antenna radiator.

2. Description of the Related Art

Wireless communication technology allows users to transmit and receive various types of information such as text, image, video or voice. Wireless communication technology is steadily advancing to transmit and receive more information in a higher speed. Along with advancement of wireless communication, electronic devices such as smartphones or tablet computers, which are operable in wireless communication, provide service using communication functions such as digital multimedia broadcasting (DMB), global positioning system (GPS), Wi-Fi, or long-term evolution (LTE). An electronic device for providing such a service using a communication function may comprise one or more antennas.

In providing various services using wireless communication, the number of frequency bands could increase in need and an electronic device may comprise a plurality of antennas. In the case that a plurality of antennas are implemented in a confined area, it becomes difficult to secure isolation between antennas, which, in turn, can lead to radiation performance degradation, due to interference between the antennas. Moreover, resonance optimization could be difficult to achieve in a desired frequency band.

SUMMARY

Aspects of the present disclosure have been made to address at least the above-mentioned problems and/or disadvantages and to provide at least the advantages described below. Accordingly, an aspect of the present disclosure is to provide an antenna that includes at least one matching block which connects with a ground area and with a side of at least one antenna radiator, and an electronic device including the antenna.

In accordance with an aspect of the present disclosure, there is provided an electronic device including a plurality of antennas. The electronic device includes a first radiator that is supplied with power from a first feeding unit, connected with a ground area at one of a contact point on the first feeding unit and at a point adjacent to the contact point on the first feeding unit, and configured to include at least one matching block that is connected with the ground area and at least one side of the first radiator. The first radiator is configured to transmit and receive a first frequency signal through a first antenna resonance length corresponding to a first area of the first radiator, and to transmit and receive a second frequency signal through a second antenna resonance length corresponding to a second area opposite to the first area. A second radiator is supplied with power from a second feeding unit and is connected with the ground area at one of a contact point of the second feeding unit and at a point adjacent to the contact point of the second feeding unit. The second radiator is configured to transmit and receive a third frequency signal through a third antenna resonance length corresponding to a third area adjacent to the first radiator.

In accordance with an aspect of the present disclosure, there is provided an electronic device with a metallic frame. The electronic device includes a first segmented part and a second segmented part that divide at least an area of the metallic frame. A first radiator is disposed between the first segmented part and the second segmented part in the metallic frame. The first radiator is connected with a first feeding unit at a point adjacent to the second segmented part, connected with a ground area at one of a contact point of the first feeding unit and at a point adjacent to the contact point of the first feeding unit, and configured to include a matching block that is connected with the ground area and a point adjacent to the first segmented part. A second radiator is disposed left of the first segmented part in the metallic frame and is connected with a second feeding unit and connected with the ground area at one of a contact point of the second feeding unit and at a point adjacent to the contact point of the second feeding unit. A third radiator is disposed right of the second segmented part in the metallic frame and is connected with a third feeding unit and connected with the ground area at one of a contact point of the third feeding unit and at a point adjacent to the contact point of the third feeding unit.

In accordance with an aspect of the present disclosure, there is provided a portable electronic device. The portable electronic device includes a case member including a first surface, a second surface facing opposite to the first surface, and a side surrounding a space between the first surface and the second surface. A first metallic member is configured to one of form a part of the side of the case member and be formed adjacent to the part of the side of the case member. A second metallic member is configured to one of form another part of the side of the case member and be formed adjacent to the another part of the side of the case member, without contacting the first metallic member. At least one wireless communication integrated circuit (IC) electrically connected with one of the first metallic member and the second metallic member. A ground member is disposed within the case member. A filter circuit is disposed adjacent to the second metallic member and electrically connected between a part of the first metallic member and the ground member.

BRIEF DESCRIPTION OF THE DRAWINGS

The above and other aspects, features, and advantages of certain embodiments of the present disclosure will be more apparent from the following detailed description taken in conjunction with the accompanying drawings, in which.

Throughout the drawings, it should be noted that like reference numbers are used to depict the same or similar elements, features, and structures.

DETAILED DESCRIPTION

Figure 1A:
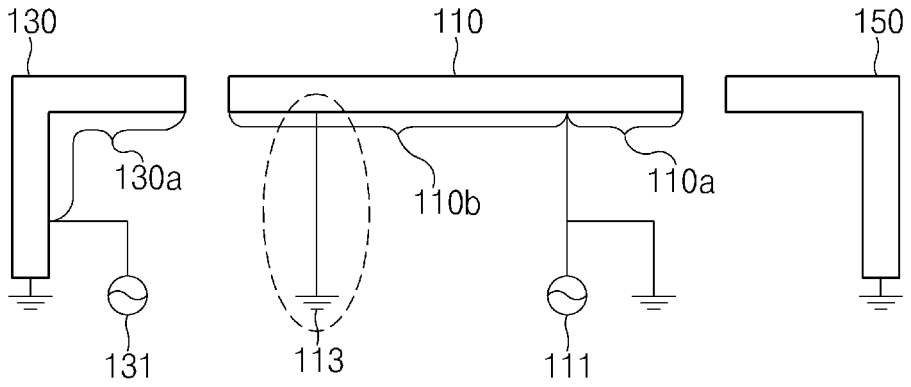
FIG. 1A is a diagram illustrating illustrates an antenna structure, according to an embodiment of the present disclosure.

Embodiments of the present disclosure will be described herein below with reference to the accompanying drawings. However, the embodiments of the present disclosure are not limited to the specific embodiments and should be construed as including all modifications, changes, equivalent devices and methods, and/or alternative embodiments of the present disclosure.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" mean (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the present invention, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a CPU or an application processor) capable of performing a corresponding operation by executing one or more software programs stored in a memory device.

The term "module" as used herein may be defined as, for example, a unit including one of hardware, software, and firmware or two or more combinations thereof. The term "module" may be interchangeably used with, for example, the terms "unit", "logic", "logical block", "component", or "circuit", and the like. The "module" may be a minimum unit of an integrated component or a part thereof. The "module" may be a minimum unit performing one or more functions or a part thereof. The "module" may be mechanically or electronically implemented. For example, the "module" may include at least one of an application-specific integrated circuit (ASIC) chip, field-programmable gate arrays (FPGAs), or a programmable-logic device, which is well known or will be developed in the future, for performing certain operations.

The terms used in describing the various embodiments of the present disclosure are for the purpose of describing particular embodiments and are not intended to limit the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even terms defined in this disclosure should not be interpreted as excluding the embodiments of the present disclosure.

Electronic devices according to the embodiments of the present disclosure may include at least one of, for example, smart phones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. According to an embodiment of the present disclosure, the wearable devices may include at least one of accessory-type wearable devices (e.g., watches, rings, bracelets, anklets, necklaces, glasses, contact lenses, or head-mounted-devices (HMDs)), fabric or clothing integral wearable devices (e.g., electronic clothes), body-mounted wearable devices (e.g., skin pads or tattoos), or implantable wearable devices (e.g., implantable circuits).

The electronic device may be a smart home appliance. The smart home appliance, for example, may include at least one of televisions (TV), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, Google TV™, and the like), game consoles (e.g., Xbox™, PlayStation™, and the like), electronic dictionaries, electronic keys, camcorders, electronic picture frames, and the like.

The electronic devices may include at least one of various medical devices (e.g., various portable medical measurement devices (such as blood glucose meters, heart rate monitors, blood pressure monitors, or thermometers, and the like), a magnetic resonance angiography (MRA) device, a magnetic resonance imaging (MRI) device, a computed tomography (CT) device, scanners, or ultrasonic devices, and the like), navigation devices, global positioning system (GPS) receivers, event data recorders (EDRs), flight data recorders (FDRs), vehicle infotainment devices, electronic equipment for vessels (e.g., navigation systems, gyrocompasses, and the like), avionics, security devices, head units for vehicles, industrial or home robots, automatic teller machines (ATMs), points of sales (POSs) devices, or Internet of Things (IoT) devices (e.g., light bulbs, various sensors, electric or gas meters, sprinkler devices, fire alarms, thermostats, street lamps, toasters, exercise equipment, hot water tanks, heaters, boilers, and the like).

The electronic devices may further include at least one of parts of furniture or buildings/structures, electronic boards, electronic signature receiving devices, projectors, or various measuring instruments (such as water meters, electricity meters, gas meters, or wave meters, and the like). The electronic devices may be one or more combinations of the above-mentioned devices. The electronic devices may be flexible electronic devices. Also, the electronic devices are not limited to the above-mentioned devices, and may include new electronic devices according to the development of new technologies.

Hereinafter, the electronic devices according to various embodiments of the present disclosure will be described with reference to the accompanying drawings. The term "user" as used herein may refer to a person who uses an electronic device or may refer to a device (e.g., an artificial intelligence electronic device) which uses an electronic device.

FIG. 1A is a diagram illustrating an antenna structure, according to an embodiment of the present disclosure.

Referring to FIG. 1A, an electronic device may include a plurality of antennas (e.g., a first antenna, a second antenna, and a third antenna). Each antenna may be implemented in a radiator (e.g., a first radiator 110, a second radiator 130, or a third radiator 150). Additionally, each radiator may be connected with a feeding unit, which supplies power, and a ground member which is connected to a ground area. For example, the first radiator 110 may be connected with a first feeding unit 111 and the second radiator 130 may be connected with a second feeding unit 131. With respect to this configuration, the ground area may be formed of a ground member.

A resonance frequency of an antenna may be determined by a length of the radiator. In the case that the radiator and its peripheral metallic part form a coupling structure, an antenna resonance length and an antenna radiation area may be changed. Accordingly, the electronic device may be improved in isolation characteristics by adjusting intervals between the radiators on purpose to minimize an effect due to the coupling, or by controlling materials or sizes of members placed between the radiators. In implementing a plurality of antennas, it may be possible to form a short circuit at a side of the radiator on purpose to secure isolation between the antennas. As illustrated, in the electronic device, an additional ground member 113 may be connected with a side of the first radiator 110 for isolation between the antennas, forming a ground short circuit. With this structure, it may be insufficient for the antennas to form frequency resonance of a specific frequency band, e.g., a low band. Frequency signals, which are transmitted and received through an antenna resonance length including a first area 110*a* of the first radiator 110 and at least one area of the third radiator 150 and through the second radiator 130 and a second area 110*b* of the first radiator 110, respectively, may not be a signal of a low frequency band.

Figure 1B:
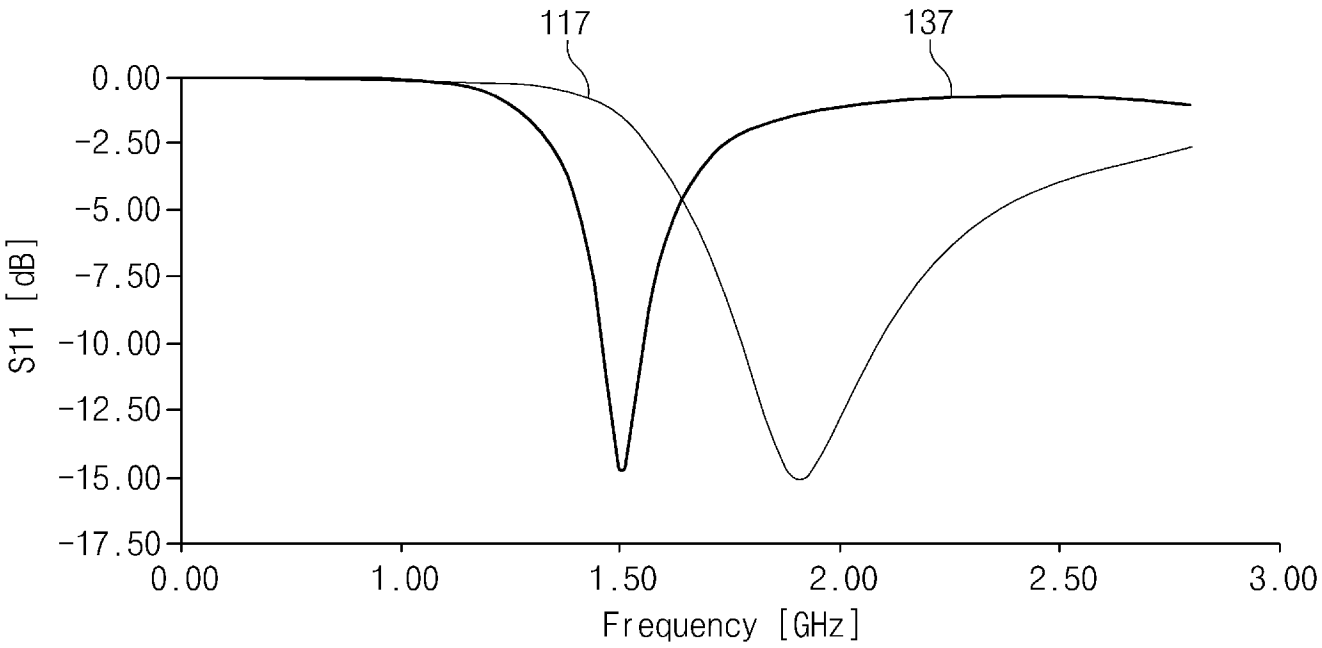
FIG. 1B is a graph of reflection coefficients measured from the antenna structure of FIG. 1A, according to an embodiment of the present disclosure.

FIG. 1B is a graph of reflection coefficients measured from the antenna structure of FIG. 1A, according to an embodiment of the present disclosure. Referring to FIG. 1B, a first reflection coefficient 117 measured from the first antenna and a second reflection coefficient 137 measured from the second antenna may indicate that it is difficult to form resonance of a low frequency band.

Figure 1C:
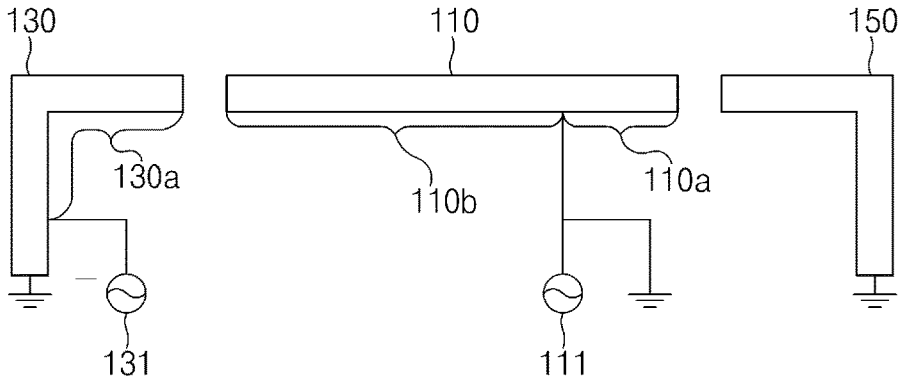
FIG. 1C is a diagram illustrating an antenna structure, according to an embodiment of the present disclosure.

FIG. 1C is a diagram illustrating an antenna structure, according to an embodiment of the present disclosure. For the purpose of forming resonance of a specific frequency band, an electronic device may be structured without an additional ground member 113 as shown in FIG. 1C. In this case, it may be possible to adjust an antenna resonance length, which allows a signal of a specific frequency band to be transmitted and received, through a second area 110*b* in a direction to which the additional ground member 113 was connected. However, in this structure, it may be difficult to secure isolation between antennas. Additionally, since the antennas are changed into a state of transmitting and receiving a signal of a high frequency band from a state of transmitting and receiving a signal of a mid/high frequency band, it may be difficult to optimize resonance of the mid/high frequency band.

Figure 1D:
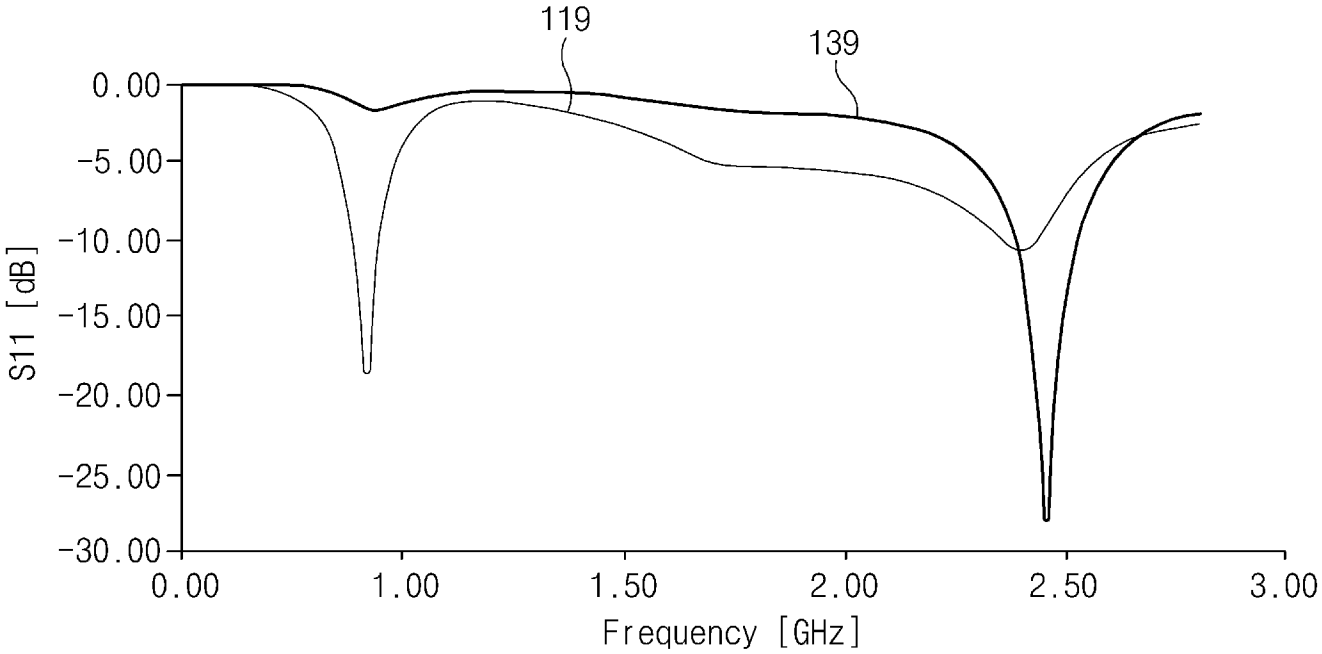
FIG. 1D is a graph of reflection coefficients measured from the antenna structure of FIG. 1C, according to an embodiment of the present disclosure.

FIG. 1D is a graph of reflection coefficients measured from the antenna structure of FIG. 1C, according to an embodiment of the present disclosure. Referring to FIG. 1D, a first reflection coefficient 119 measured from the first antenna and a second reflection coefficient 139 measured from the second antenna may indicate that it is difficult to form resonance of a mid/high frequency band. For the purpose of compensating such shortness, an electronic device may be equipped with at least one matching block which is connected with a ground area and a side of a radiator. A structure with connection of a matching block will be described below.

Figure 2A:
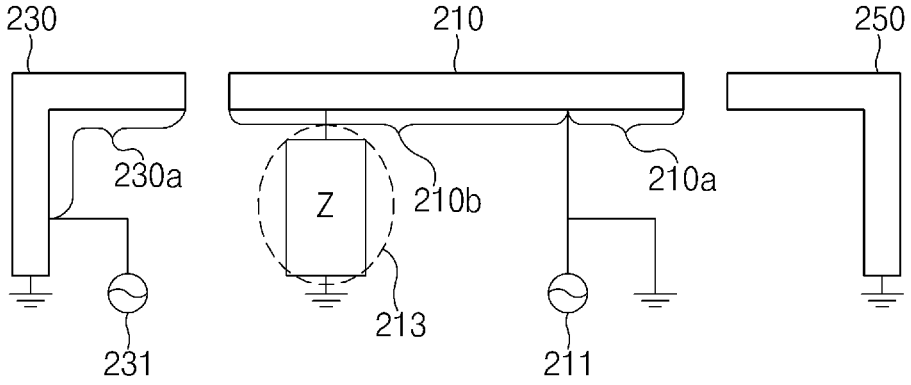
FIG. 2A is a diagram illustrating an antenna structure connected with a matching block, according to an embodiment of the present disclosure.
Figure 2B:
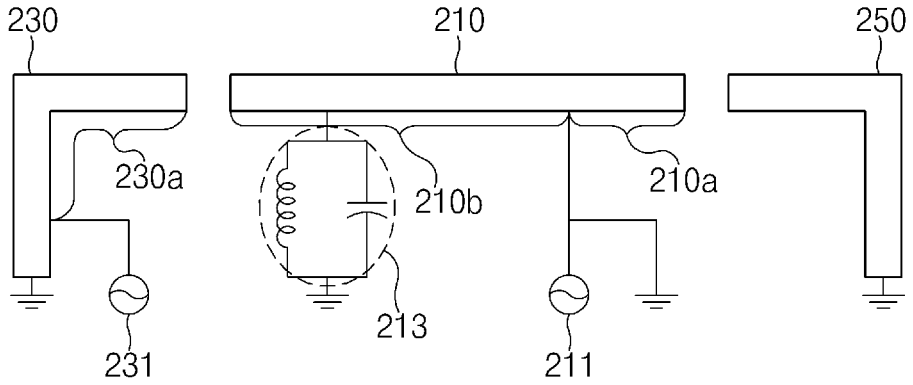
FIG. 2B is a diagram illustrating the matching block of FIG. 2A including an inductor and a capacitor in a parallel connection, according to an embodiment of the present disclosure.
Figure 2C:
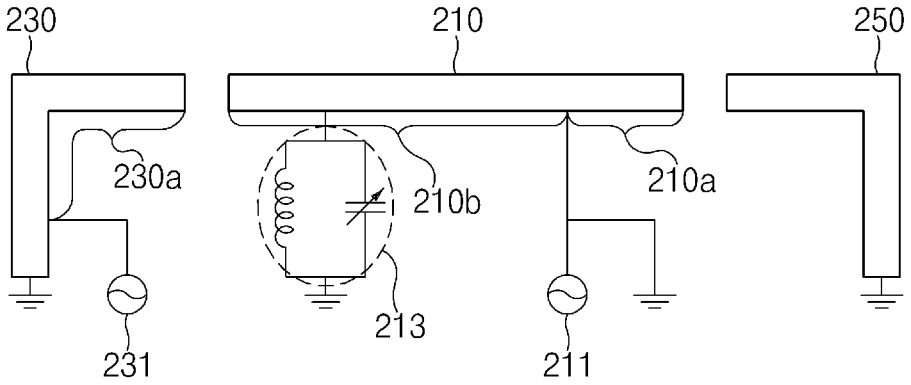
FIG. 2C is a diagram illustrating the matching block of FIG. 2A including an inductor and a variable capacitor in parallel connection, according to an embodiment of the present disclosure.

FIG. 2A is a diagram illustrating an antenna structure connected with a matching block, FIG. 2B is a diagram illustrating the matching block of FIG. 2A prepared with an inductor and a capacitor in parallel connection, and FIG. 2C is a diagram illustrating the matching block of FIG. 2A prepared with an inductor and a variable capacitor in parallel connection, according to an embodiment of the present disclosure. An electronic device may comprise a plurality of antennas. Although an electronic device is illustrated as comprising a first antenna, a second antenna, and a third antenna, the number of antennas may not be restrictive hereto.

Referring to FIGS. 2A-2C, the first antenna may include a first radiator 210, a first feeding unit 211, and a matching block 213. The first radiator 210 may transmit and receive a signal of a specific frequency band. The first radiator 210 may form frequency resonance of a first frequency band through an antenna resonance length including a first area 210*a*, which is directed adjacent to a third radiator 250 from a point to which the first feeding unit 211 is connected, and at least a partial area of the third radiator 250. Additionally, the first radiator 210 may form frequency resonance of a second frequency band through an antenna resonance length including a second area 210*b*, which is directed adjacent to a second radiator 230 from a point to which the first feeding unit 211 is connected, and at least a partial area of the second radiator 230. Depending on lengths of the first area 210*a* and the second area 210*b*, the first frequency band may be higher than the second frequency band. In the first radiator 210, the first feeding unit 211 may be connected to a ground area at a contact point of the first feeding unit 211 or at a point adjacent to the contact point of the feeding unit 211.

The first feeding unit 211 may supply, for example, power into the first radiator 210. The first feeding unit 211 may be connected adjacent to a side (e.g., a right side) of the first radiator 210. The first feeding unit 211 may be connected to the ground area.

The matching block 213, as an electric circuit having specific impedance, may be a kind of matching circuit (or filter circuit) for selectively interrupting or passing a signal of a specific frequency band through elements forming the matching block 213. The matching block 213 may be formed of at least one inductor and at least one capacitor. In this case, the matching block 213 may select a specific frequency through an electrical resonance effect that appears at the specific frequency determined by inductance and capacitance. As illustrated in FIG. 2B, in the case that the matching block 213 is formed of a parallel resonance circuit where an inductor and a capacitor are connected in parallel, the matching block 213 may be implemented with open circuit characteristics by an infinite operating frequency (resonance frequency). As illustrated in FIG. 2C, the matching block 213 may be even formed including at least one capacitor which is made up with a variable capacitor.

The matching block 213 may be connected adjacent to a side (e.g., a right side) of the first radiator 210. Additionally, the matching block 213 may be connected with the ground area and placed between the first radiator 210 and the ground area, performing a switching (or filtering) function to interrupt a signal of a specific frequency band to flow into the ground area. By connecting the matching block 213 with the second area 210*b* of the first radiator 210 adjacent to the second radiator 230, the electronic device may form frequency resonance of a specific frequency band through a resonance length including the second area 210*b* and at least a partial area of the second radiator 230. Additionally, the electronic device may force a frequency signal, which is out of the specific frequency band, to flow into the ground area through the matching block 213, thus securing isolation between the first radiator 210 and the second radiator 230.

The second antenna may include the second radiator 230 and a second feeding unit 231. The second radiator 230 may transmit and receive a signal of a specific frequency band. The second radiator 230 may form an antenna resonance length including a third area 230*a* of the second radiator 230 and at least a partial area of the second area 210*b* of the first radiator 210, through a coupling operation in an area adjacent to the first radiator 210, and thereby may frequency resonance of a third frequency band. Even signals of a first frequency band and a second frequency band may be originated from an antenna resonance length by a coupling operation. For example, a coupling may be generated even in an area adjacent to the first radiator 210 and the third radiator 250. Accordingly, frequency resonance of the first frequency band may be formed through an antenna resonance length including the first area 210*a* of the first radiator 210 and at least a partial area of the third radiator 250. The second radiator 230 may be connected to the ground area at a side of the second radiator 230.

The second feeding unit 231 may supply poser into the second radiator 230. The second feeding unit 231 may be connected with the second radiator 230 at a point adjacent to a point where the second radiator 230 is connected with the ground area.

The third antenna may include the third radiator 250. The third radiator 250 may transmit and receive a signal of a specific frequency band. The third radiator 250 may be connected to the ground area at a side. Although the third antenna is illustrated as excluding a feeding unit, the third antenna may include such a feeding unit. In this case, the third radiator 250 may be connected to a feeding unit in the same or similar structure with the first radiator 210 or the second radiator 230.

Figure 3A:
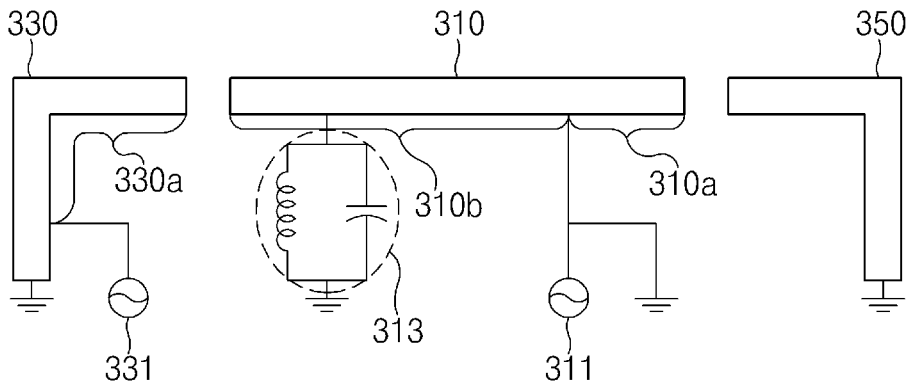
FIGS. 3A and 3B are diagrams illustrating antenna structures including LC resonance circuits, according to an embodiment of the present disclosure.
Figure 3B:
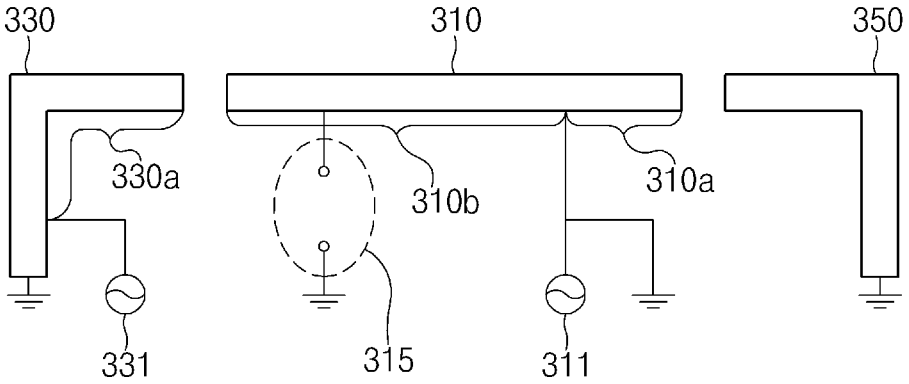
Figure 3C:
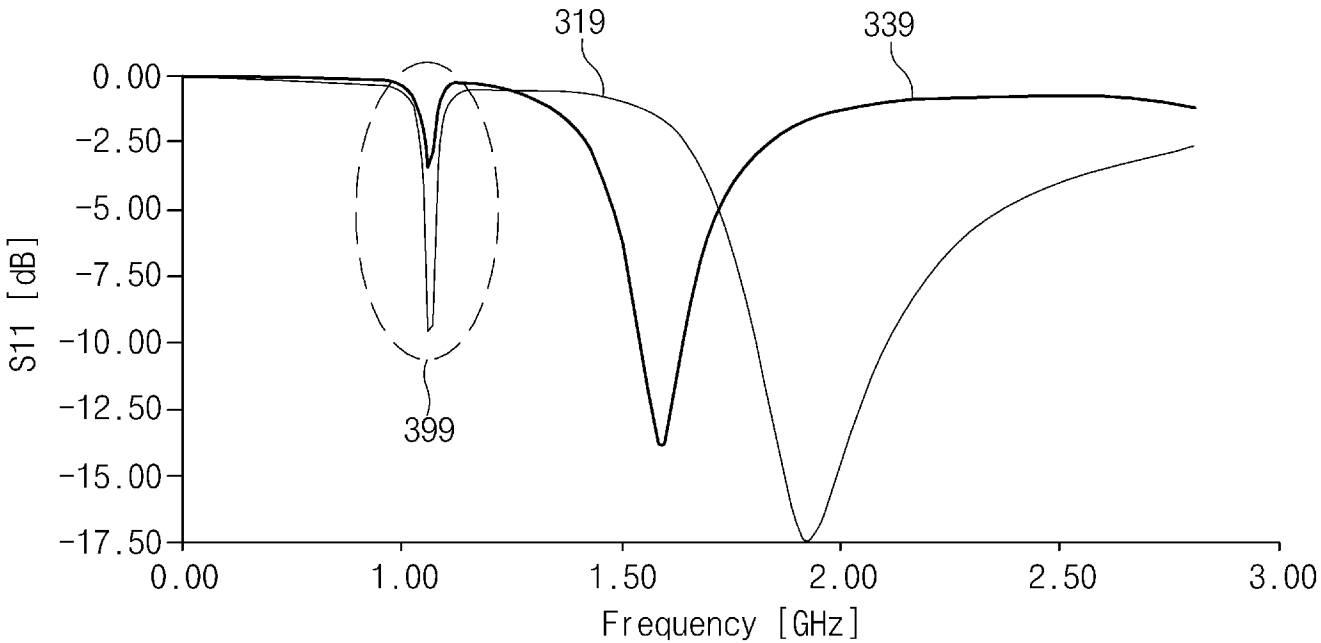
FIG. 3C is a graph of reflection coefficients measured from the antenna structures of FIGS. 3A and 3B, according to an embodiment of the present disclosure.

FIGS. 3A and 3B are diagrams illustrating antenna structures of LC resonance circuits, and FIG. 3C is a graph of reflection coefficients measured from the antenna structures of FIGS. 3A and 3B, according to an embodiment of the present disclosure. Antenna structures illustrated in FIGS. 3A and 3B may be same with or similar to the antenna structures illustrated in FIGS. 2A-2C. Hereafter the same or similar configuration will not be further described later.

Referring to FIG. 3A, the first radiator 310 may be connected with a ground area through an LC resonance circuit 313 in a frequency band out of a specific frequency (e.g., resonance frequency) that is determined by inductance and capacitance of the LC resonance circuit 313. In this case, a length of a first area 310*a* of the first radiator 310 may be used to adjust a resonance frequency of a first frequency band, and a length of a third area 330*a* may be adjusted to allow transmission and reception of a signal of a third frequency band through the second radiator 330. Additionally, the electronic device may secure isolation between antennas by allowing a signal, which is our of the specific frequency band, to flow through the LC resonance circuit 313. This configuration permits a coupling in an area adjacent to the first radiator 310 and the second radiator 330, thus preventing antenna characteristics from varying.

Referring to FIG. 3B, the LC resonance circuit 313 may have open circuit characteristics in the specific frequency. The LC resonance circuit 313 may have infinite impedance due to parallel connection between an inductor and a capacitor and thereby may act as an open circuit at the specific frequency (e.g., resonance frequency). In this case, the first radiator 310 may transmit and receive a signal of a second frequency band (e.g., low band) through an antenna resonance length including a second area 310*b*.

Referring to FIG. 3C, it can be seen from a first reflection coefficient, which is measured from a first antenna, and from a second reflection coefficient measured from a second antenna that resonance may be induced in a low frequency band 399. As described above, by connecting the LC resonance circuit 313, which is connected with the ground area, with a side of the first radiator 310, it may be possible to form resonance of a low frequency band by open circuit characteristics in the low frequency band and it may be possible to secure isolation between antennas by a ground short circuit through the LC resonance circuit in a mid/high frequency band.

Figure 4A:
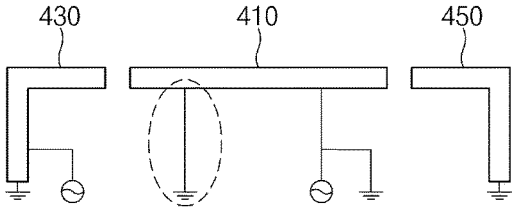
FIG. 4A is a diagram illustrating an antenna structure with a ground short circuit that is configured by connecting an additional ground member with a side of an antenna radiator, according to an embodiment of the present disclosure.
Figure 4B:
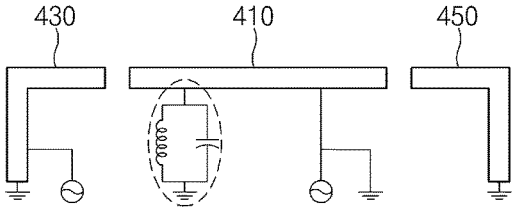
FIG. 4B is a diagram illustrating an antenna structure in which an LC resonance circuit is connected with a ground area and with a side of an antenna radiator, according to an embodiment of the present disclosure.

FIG. 4A is a diagram illustrating an antenna structure with a ground short circuit that is configured by connecting an additional ground member with a side of an antenna radiator, and FIG. 4B is a diagram illustrating an antenna structure in which an LC resonance circuit is connected with a ground area and with a side of an antenna radiator, according to an embodiment of the present disclosure.

Figure 4C:
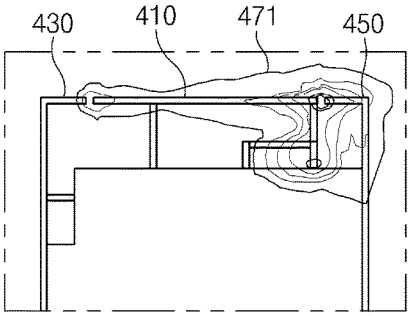
FIG. 4C is a diagram illustrating a distribution of electric field measured in the antenna structure of FIG. 4A in a specific frequency band, according to an embodiment of the present disclosure.
Figure 4D:
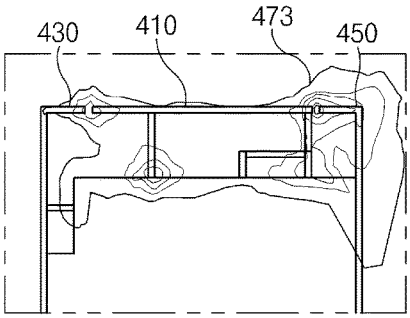
FIG. 4D is a diagram illustrating a distribution of electric field measured in the antenna structure of FIG. 4A in a specific frequency band, according to an embodiment of the present disclosure.
Figure 4E:
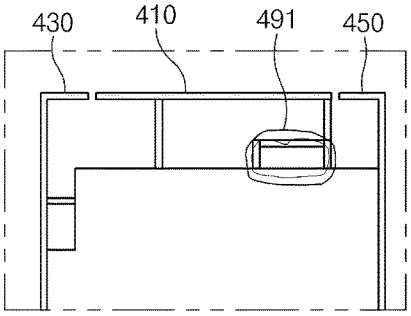
FIG. 4E is a diagram illustrating a distribution of magnetic field measured in the antenna structure of FIG. 4A in a specific frequency band, according to an embodiment of the present disclosure.
Figure 4F:
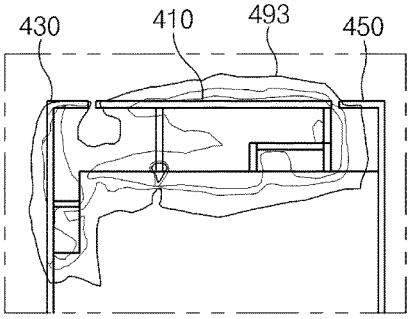
FIG. 4F is a diagram illustrating a distribution of magnetic field measured in the antenna structure of FIG. 4A in a specific frequency band, according to an embodiment of the present disclosure.

FIG. 4C is a diagram illustrating a distribution of electric field measured in the antenna structure of FIG. 4A in a specific frequency band, FIG. 4D is a diagram illustrating a distribution of electric field measured in the antenna structure of FIG. 4A in a specific frequency band, FIG. 4E is a diagram illustrating a distribution of magnetic field measured in the antenna structure of FIG. 4A in a specific frequency band, and FIG. 4F is a diagram illustrating a distribution of magnetic field measured in the antenna structure of FIG. 4A in a specific frequency band, according to an embodiment of the present disclosure.

The distributions of electric and magnetic fields illustrated in FIGS. 4C 4F show distributions of electric fields 471 and 473 and magnetic fields 491 and 493. As shown in the drawings, it can be seen that electric and magnetic fields are distributed throughout a first radiator 410, a second radiator 430, and a third radiator 450 in open circuit characteristics when an LC resonance circuit is set on an operating frequency (resonance frequency) of the specific frequency band.

Figure 5:
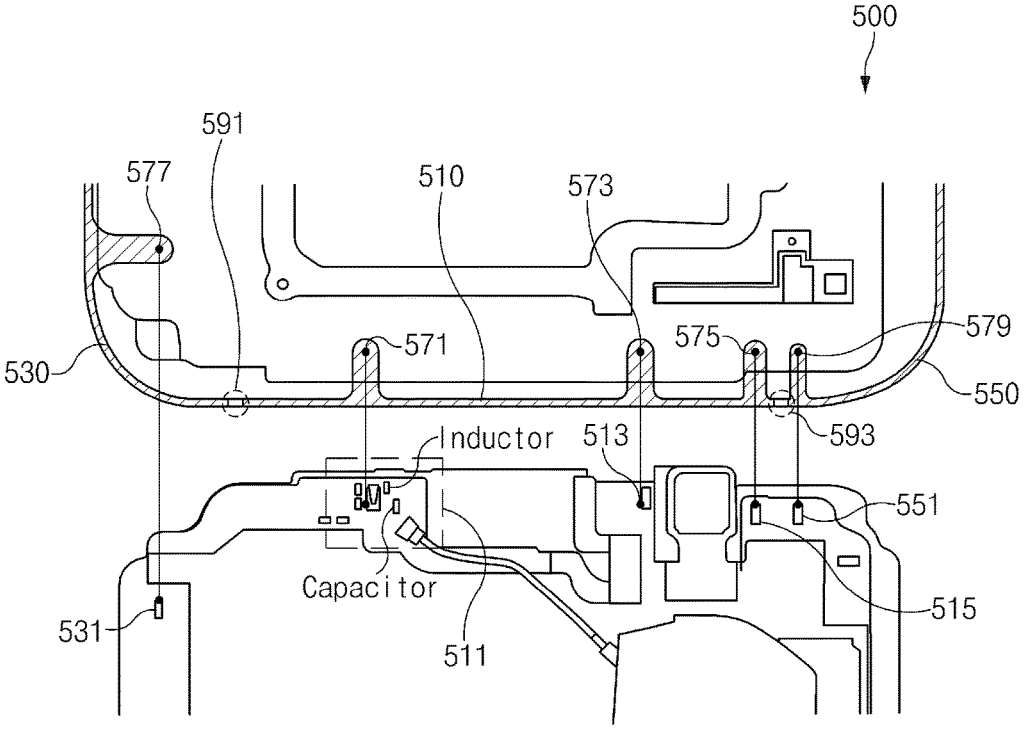
FIG. 5 is a diagram illustrating an antenna structure using a metallic frame of an electronic device, according to an embodiment of the present disclosure.

FIG. 5 is a diagram illustrating an antenna structure using a metallic frame of an electronic device, according to an embodiment of the present disclosure. An electronic device 500 may include a metallic frame which forms an exterior of the electronic device 500. The electronic device 500 with such a metallic frame structure may utilize the metallic frame itself as radiators by segmenting the metallic frame. FIG. 5 discloses only a part of the electronic device 500.

Referring to FIG. 5, in the electronic device 500, the metallic frame may be divided into a first segmented part 591 and a second segmented part 593 and may be used as a first radiator 510, a second radiator 530, and a third radiator 550 in itself. The first radiator 510 may be connected through an LC resonance circuit 511, which is connected with a ground area, and a first connection part 571. The first connection part 571 through a fifth connection part 579 may be disposed adjacent to the metallic frame and may allow diverse circuits, which form antennas, to be connected with the metallic frame. The first connection part 571 through the fifth connection part 579 may be a given area of a conductor which is elongated from the metallic frame. For example, the connection parts may be connected respectively through the elongated parts in the first radiator 510, the second radiator 530, and the third radiator 550. In this case, except an area corresponding to the first connection part 571 through the fifth connection part 579 which are connected with the circuits, the peripheral area may be made of an insulating material or may be covered by an insulating material. FIG. 5 is illustrated as a semiconductor elongated from the first radiator 510 which is connected with the first connection part 571, a second connection part 573, and a third connection part 575. A conductor elongated from the second radiator 530 is connected with a fourth connection part 577; and a conductor elongated from the third radiator 550 is connected with the fifth connection part 579.

The first radiator 310 may be supplied with power in connection through a first feeding unit 513 and the second connection part 573. Additionally, the first radiator 510 may be connected with a ground member 515 through the third connection part 575. The ground member 515 may perform a function of connection to the ground area in the electronic device 500.

The second radiator 530 may be supplied with power in connection through a second feeding unit 531 and the fourth connection part 577. The third radiator 550 may be supplied with power in connection through a third feeding unit 551 and the fifth connection part 579. The second radiator 530 and the third radiator 550 may be connected with the ground area through their sides.

A coupling may be generated between antennas at the first segmented part 591 and the second segmented part 593. For example, the first radiator 510 and the second radiator 530 may operate in a coupling at the first segmented part 591, and the first radiator 510 and the third radiator 350 may operate in a coupling at the second segmented part 593.

Figure 6:
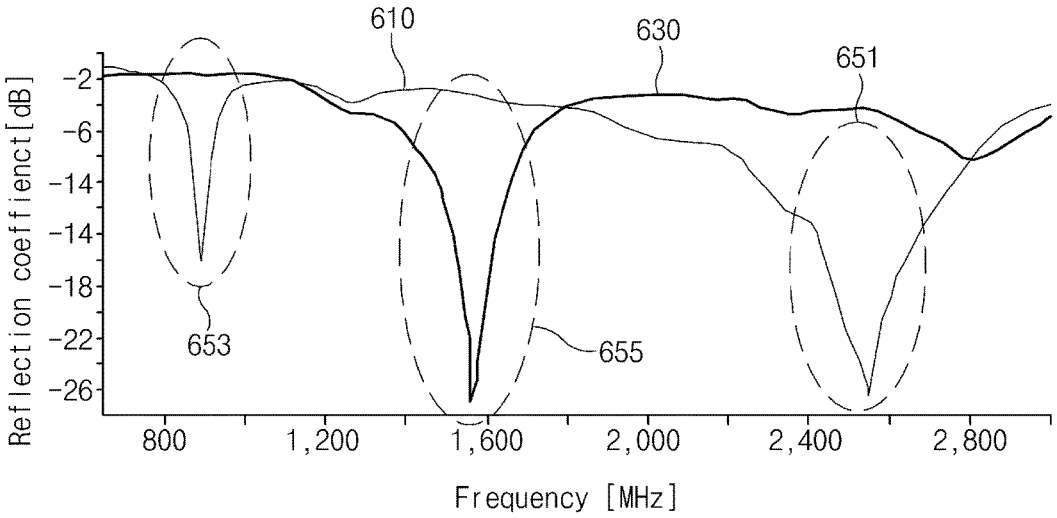
FIG. 6 is a graph of reflection coefficients measured from an antenna structure using a metallic frame of an electronic device, according to an embodiment of the present disclosure.

FIG. 6 is a graph of reflection coefficients measured from an antenna structure using a metallic frame of an electronic device, according to an embodiment of the present disclosure. FIG. 6 shows a graph of reflection coefficients measured from an antenna structure having an LC resonance circuit 511 formed of an inductor (e.g., 3.9 nH) and a capacitor (e.g., 4 pF), which are specifically valued in inductance and capacitance respectively, in an electronic device 500 with a metallic frame structure.

Referring to FIG. 6, from a first reflection coefficient 610 measured from a first antenna (the middle antenna formed of the first radiator 510 of FIG. 5) and from a second reflection coefficient 630 measured from a second antenna (the left upper antenna formed of the second radiator 530 of FIG. 5), it may be possible even to generate resonance in a low frequency band like a second frequency band 653 and even to generate resonance in a mid/high frequency band like a third frequency band 655.

Figure 7A:
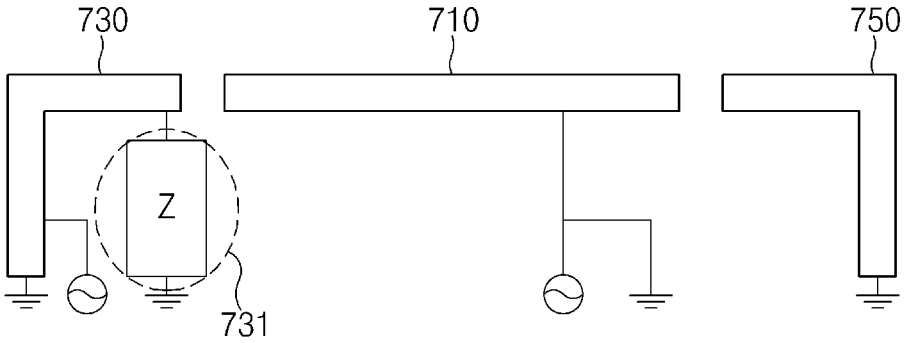
FIG. 7A is a diagram illustrating a connection location of a matching block, according to an embodiment of the present disclosure.
Figure 7B:
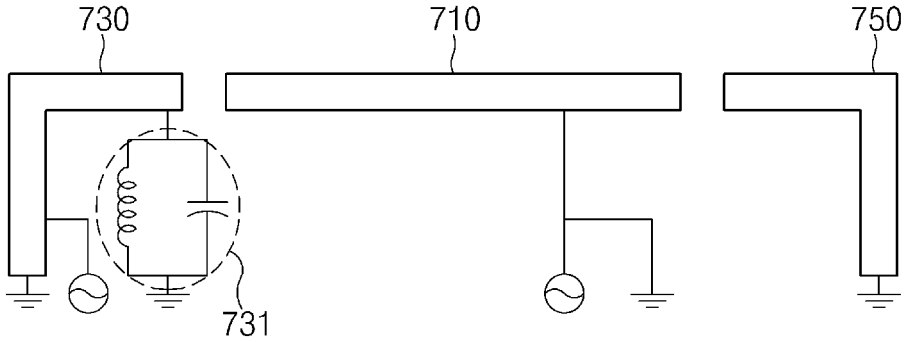
FIG. 7B is a diagram illustrating a matching block of FIG. 7A, with a parallel resonance circuit in which an inductor and a capacitor are connected in parallel, according to an embodiment of the present disclosure.
Figure 7C:
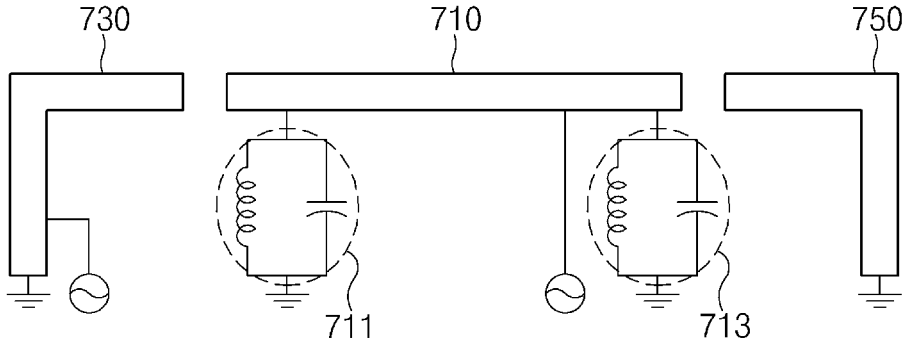
FIG. 7C is a diagram illustrating two matching blocks, according to an embodiment of the present disclosure.

FIG. 7A is a diagram illustrating a connection location of a matching block, FIG. 7B is a diagram illustrating a matching block of FIG. 7A, with a parallel resonance circuit in which an inductor and a capacitor are connected in parallel, and FIG. 7C is a diagram illustrating two matching blocks, according to an embodiment of the present disclosure.

Referring to FIG. 7A, an antenna structure is formed by connecting a matching block 731, which is connected with a ground area, adjacent to a side of a second radiator 730 but a side of a first radiator 710. In the case of disposing the matching block 731 adjacent to the first radiator 710 and the second radiator 730, operating characteristics may be substantially similar or the same between a side of the first radiator 710 and a side of the second radiator 720. Frequency bands transmittable and receivable through the first radiator 710 and the second radiator 730 may be some variable in accordance with the connection locations. A matching block may be an LC resonance circuit formed of at least one inductor and at least one capacitor, or a shown in FIG. 7B, may be a parallel resonance circuit in which an inductor and a capacitor are connected in parallel.

Referring to FIG. 7C, an antenna structure is formed by connecting a first LC resonance circuit 711 and a second LC resonance circuit 713, which are connected with a ground area, adjacent to both sides of a first radiator 710. In this case, it may be possible to exclude a connection part for connecting a side of the first radiator 710 with the ground area. Additionally, the second LC resonance circuit 713 may be disposed adjacent to the first radiator 710 and the second radiator 750. Thus, resonance may be generated at a specific frequency that is determined by an inductor and a capacitor of the second LC resonance circuit, securing isolation between antennas.

Figure 8A:
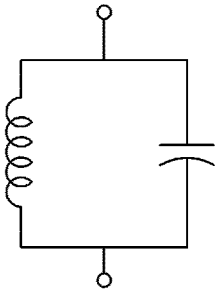
FIG. 8A is a diagram illustrating a matching block in which an inductor and a capacitor are connected in parallel, according to an embodiment of the present disclosure.
Figure 8B:
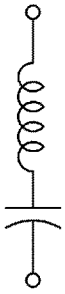
FIG. 8B is a diagram illustrating a matching block in which an inductor and a capacitor are connected in series, according to an embodiment of the present disclosure.
Figure 8C:
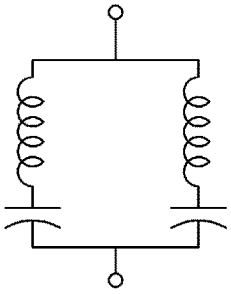
FIG. 8C is a diagram illustrating a matching block in which a plurality of inductors and a plurality of capacitors are connected in series and parallel, according to an embodiment of the present disclosure.
Figure 8D:
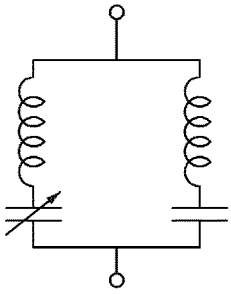
FIG. 8D is a diagram illustrating the matching block, which is shown in FIG. 8C, including a variable capacitor, according to an embodiment of the present disclosure.

FIG. 8A is a diagram illustrating a matching block in which an inductor and a capacitor are connected in parallel, FIG. 8B is a diagram illustrating a matching block in which an inductor and a capacitor are connected in series, FIG. 8C is a diagram illustrating a matching block in which a plurality of inductors and a plurality of capacitors are connected in series and parallel, and FIG. 8D is a diagram illustrating the matching block, which is shown in FIG. 8C, including a variable capacitor, according to an embodiment of the present disclosure.

Referring to FIGS. 8A-8D, a matching block may be formed in diverse combinations with impedance. As illustrated in FIG. 8A, a matching block may be formed in a Parallel LC resonance circuit in which an inductor and a capacitor are connected in parallel. In the Parallel LC resonance circuit, it may be possible to implement open circuit characteristics in infinite operating frequency. In this case, the Parallel LC resonance circuit may cause a signal of an operating frequency band to hardly pass through the Parallel LC resonance circuit.

A matching block may be formed in a Serial LC resonance circuit in which an inductor and a capacitor are connected in series as illustrated in FIG. 8B. In the Serial LC resonance circuit, its impedance may become zero in an operating frequency to result in a short circuit. In this case, the Serial LC resonance circuit may easily pass a signal of an operating frequency signal through itself.

As illustrated in FIG. 8C, a matching block may be even formed in a mixed type where a plurality of inductors and a plurality of capacitors are connected in series and parallel. Additionally, a matching block may be even formed by adopting a variable capacitor as at least a capacitor.

Figure 9:
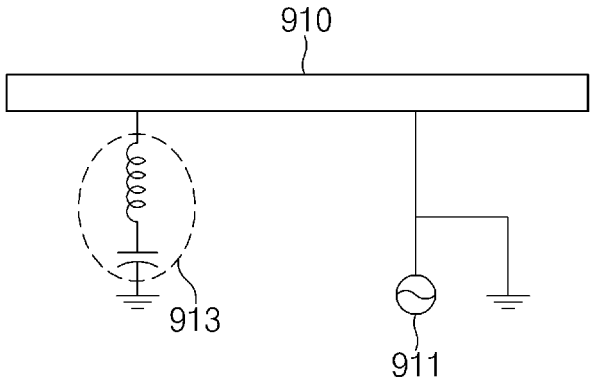
FIG. 9 is a diagram illustrating an antenna structure connected with a serial LC resonance circuit, according to an embodiment of the present disclosure.

FIG. 9 is a diagram illustrating an antenna structure connected with a serial LC resonance circuit, according to an embodiment of the present disclosure.

Referring to FIG. 9, an antenna may include a radiator 910, a feeding unit 911, and a serial LC resonance circuit 913. The radiator 910 may transmit and receive a signal of a specific frequency band. The feeding unit 911 may be connected adjacent to a side (e.g., a right side) of the radiator 910. The feeding unit 911 may supply power to the radiator 910. Additionally, the serial LC resonance circuit 913 may be connected adjacent to the other side (e.g., a left side) of the radiator 910. The serial LC resonance circuit may be connected with a ground area and may be disposed between the radiator 910 and the ground area to allow a signal of a specific frequency (e.g., resonance frequency) band to flow into the ground area. According to various embodiments, by connecting the serial LC resonance circuit 913 at a designated point of the radiator 910, a signal of a specific frequency band may be transmitted and received through as much as a length including a contact point of the feeding unit 911 and a contact point of the serial LC resonance circuit 913.

An antenna may include a radiator transmitting and receiving a specific frequency signal, a feeding unit connected with the radiator and configured to supply power into the radiator, wherein the radiator may be connected with a ground area at a contact point of the feeding unit or at a point adjacent to the contact point of the feeding unit, and wherein at least one matching block connected with the ground area may be connected with at least one of both sides of the radiator.

The matching block may be configured in at least one of serial connection and parallel connection with at least one inductor and at least one capacitor.

An electronic device having a plurality of antennas may include a first radiator supplied with power from a first feeding unit and connected with a ground area, and a second radiator supplied with power from a second feeding unit and connected with the ground area. The first radiator may be connected with at least one matching block that is connected with the ground area. The first radiator may transmit and receive a first frequency signal through a first antenna resonance length corresponding to a first area, directed to the at least one matching block from the first feeding unit, of the first radiator. The first radiator may transmit and receive a second frequency signal through a second antenna resonance length corresponding to a second area opposite to the first area. And the second radiator may transmit and receive a third frequency signal through a third antenna resonance length corresponding to a third area adjacent to the first radiator.

The first antenna resonance length may be formed by a resonant frequency formed by the at least one matching block.

The first frequency signal may have a frequency that is lower than a frequency of the second frequency signal.

The first radiator may form a coupling in an area adjacent to the second radiator.

The at least one matching block may be connected adjacent to a side of the first radiator.

The at least one matching block may include at least one inductor and at least one capacitor in one of a serial configuration and a parallel configuration.

An electronic device with a metallic frame may include a first segmented part and a second segmented part that divide at least an area of the metallic frame, a first radiator disposed between the first segmented part and the second segmented part in the metallic frame and connected with a first feeding unit and a ground area, a second radiator disposed left of the first segmented part in the metallic frame and connected with a second feeding unit and the ground area, and a third radiator disposed right of the second segmented part in the metallic frame and connected with a third feeding unit and the ground area. The first radiator may be connected with at least one matching block that is connected with the ground area.

The first segmented part and the second segmented part may be formed of an insulating material that electrically isolates the metallic frame.

The first radiator may transmit and receive a first frequency signal through a first antenna resonance length corresponding to a first area, directed to the first segmented part from a contact point of the first feeding unit, of the first radiator. The first radiator may transmit and receive a second frequency signal through a second antenna resonance length corresponding to a second area, opposite to the first area. And the second radiator may transmit and receive a third frequency signal through a third antenna resonance length corresponding to a third area adjacent to the first radiator.

The first antenna resonance length may be formed by a resonant frequency formed by the at least one matching block.

The third frequency may have a frequency that is higher than a frequency of the first frequency signal and that is lower than a frequency of the second frequency signal.

The first radiator may form a coupling with the second radiator at the first segmented part, and may form a coupling with the third radiator at the second segmented part.

A portable electronic device may include a case member including a first surface, a second surface facing opposite to the first surface, and a side surrounding a space between the first surface and the second surface. A first metallic member may form a part of the side of the case member or be formed adjacent to the part of the side of the case member. A second metallic member may form the other part of the side of the case member or be formed adjacent to the other part of the side of the case member without contacting the first metallic member. At least one wireless communication integrated circuit (IC) may be electrically connected with the first metallic member and/or the second metallic member. A ground member may be disposed within the case member. And a filter circuit may be disposed adjacent to the second metallic member and be electrically connected between a part of the first metallic member and the ground member.

The first metallic member may form at least a part of a first antenna for wireless communication in a first frequency band.

The second metallic member may form at least one of a second antenna for wireless communication in a second frequency band substantially different from the first frequency band.

The filter circuit may allow at least a portion of a signal having a frequency of the second frequency band to be passed.

The filter circuit may include at least one inductor and at least one capacitor that are electrically connected in a parallel configuration or a serial configuration between a part of the first metallic member and the ground member.

The first frequency band may include frequencies that are selected from a range of 700 to 1000 MHz, and the second frequency band may include frequencies selected from a range of 1400 to 3000 MHz.

The portable electronic device may further include an insulating member that is disposed between the first metallic member and the second metallic member.

Figure 10:
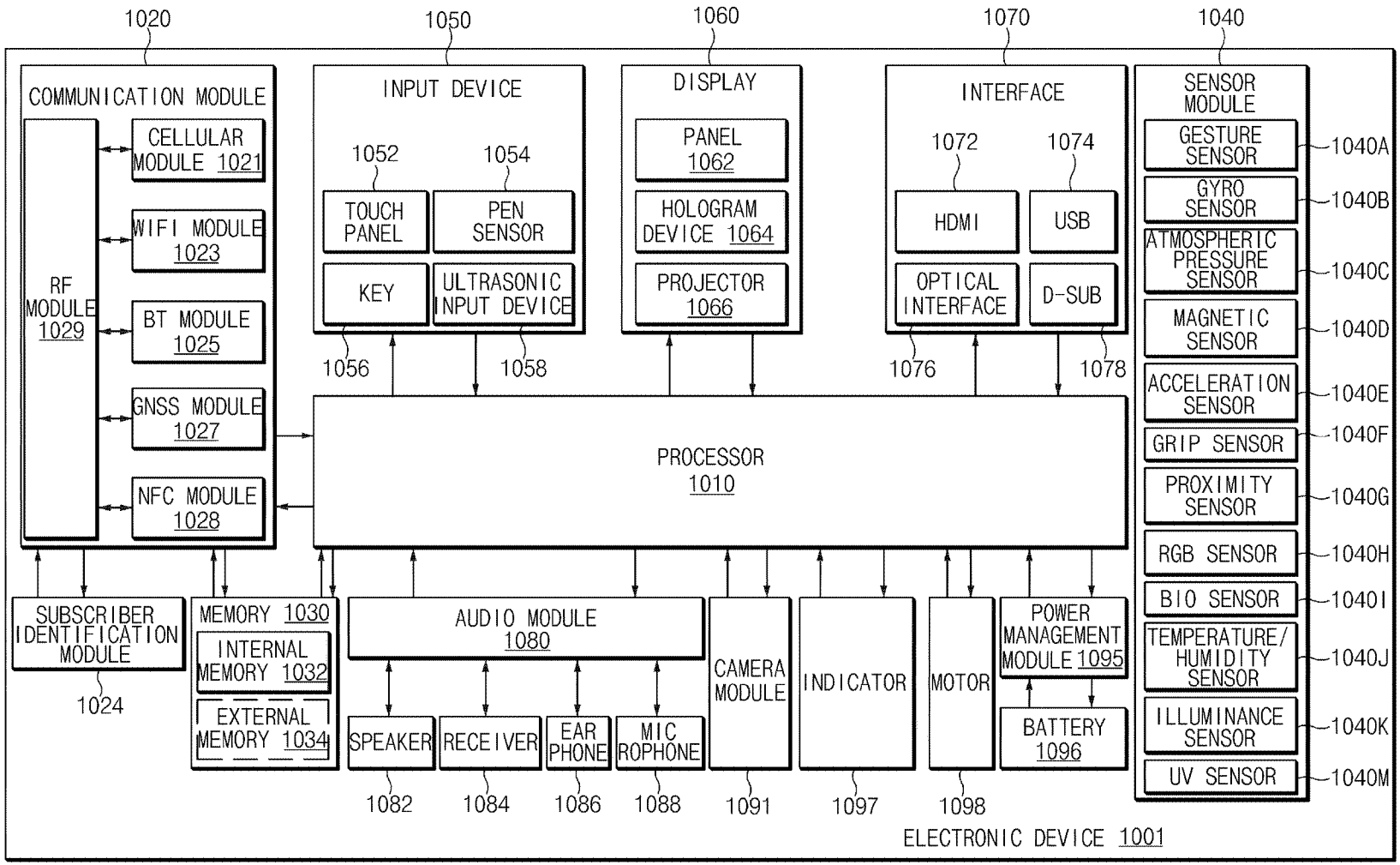
FIG. 10 is a diagram of an electronic device, according to an embodiment of the present disclosure.

FIG. 10 is a diagram of an electronic device 1001 according to an embodiment of the present disclosure. The electronic device 1001 may include, for example, all or a part of elements of the antenna structure shown in FIG. 2. Referring to FIG. 10, the electronic device 1001 may include at least one of one or more application processors (AP) 1010, a communication module 1020, a subscriber identification module (SIM) 1024, a memory 1030, a sensor module 1040, an input device 1050, a display 1060, an interface 1070, an audio module 1080, a camera module 1091, a power management module 1095, a battery 1096, an indicator 1097, or a motor 1098.

The processor (AP) 1010 may drive an operating system (OS) or an application to control a plurality of hardware or software elements connected to the processor 1010 and may process and compute a variety of data including multimedia data. The processor 1010 may be implemented with a system-on-chip (SoC), for example. The processor 1010 may further include a graphic processing unit (GPU) and/or an image signal processor. The processor 1010 may even include at least a part of the elements shown in FIG. 10. The processor 1010 may process instructions or data, which are received from at least one of other elements (e.g., a nonvolatile memory), and then store diverse data into such a nonvolatile memory.

The communication module 1020 may include a cellular module 1021, a Wi-Fi module 1023, a Bluetooth (BT) module 1025, a GNSS module 1027, an NFC module 1028, and a radio frequency (RF) module 1029.

The cellular module 1021 may provide voice call, video call, a character service, or an Internet service through a communication network. The cellular module 1021 may perform discrimination and authentication of an electronic device within a communication network using the SIM 1024. The cellular module 1021 may perform at least a portion of functions that the processor 1010 provides. The cellular module 1021 may include a communication processor (CP).

Each of the Wi-Fi module 1023, the Bluetooth module 1025, the GNSS module 1027, and the NFC module 1028 may include, for example, a processor for processing data exchanged through a corresponding module. At least a part (e.g., two or more elements) of the cellular module 1021, the Wi-Fi module 1023, the Bluetooth module 1025, the GNSS module 1027, and the NFC module 1028 may be included within one integrated circuit (IC) or an IC package.

The RF module 1029 may transmit and receive, for example, communication signals (e.g., RF signals). The RF module 1029 may include a transceiver, a power amplifier module (PAM), a frequency filter, a low noise amplifier (LNA), or an antenna. At least one of the cellular module 1021, the Wi-Fi module 1023, the Bluetooth module 1025, the GNSS module 1027, and the NFC module 1028 may transmit and receive an RF signal through a separate RF module.

The SIM 1024 may a card and/or an embedded SIM, and include unique identifying information (e.g., integrated circuit card identifier (ICCID)) or subscriber information (e.g., integrated mobile subscriber identify (IMSI)).

The memory 1030 may include, for example, an internal memory 1032 or an external memory 1034. For example, the internal memory 1032 may include at least one of a volatile memory (e.g., a dynamic random access memory (RAM) (DRAM), a static RAM (SRAM), a synchronous dynamic RAM (SDRAM), etc.), a nonvolatile memory (e.g., a one-time programmable read only memory (ROM) (OTPROM), a programmable ROM (PROM), an erasable and programmable ROM (EPROM), an electrically erasable and programmable ROM (EEPROM), a mask ROM, a flash ROM, a NAND flash memory, a NOR flash memory, etc.), a hard drive, or solid state drive (SSD).

The external memory 1034 may further include a flash drive, for example, a compact flash (CF), a secure digital (SD), a micro-secure digital (SD), a mini-SD, an extreme digital (xD), or a memory stick. The external memory 1034 may be functionally and/or physically connected with the electronic device 1001 through various interfaces.

The sensor module 1040 may measure, for example, a physical quantity, or detect an operation state of the electronic device 1001, to convert the measured or detected information to an electric signal. The sensor module 1040 may include at least one of a gesture sensor 1040A, a gyro sensor 1040B, a barometric pressure sensor 1040C, a magnetic sensor 1040D, an acceleration sensor 1040E, a grip sensor 1040F, a proximity sensor 1040G, a color sensor 1040H (e.g., RGB sensor), a biometric sensor 1040I, a temperature/humidity sensor 1040J, an illuminance sensor 1040K, or an UV sensor 1040M. Additionally or alternatively, though not shown, the sensor module 840 may further include an E-nose sensor, an electromyography sensor (EMG) sensor, an electroencephalogram (EEG) sensor, an electrocardiogram (ECG) sensor, an infrared (IR) sensor, an iris sensor, or a fingerprint sensor, for example. The sensor module 1040 may further include a control circuit for controlling at least one or more sensors included therein. In some embodiments, the electronic device 1001 may further include a processor, which is configured to control the sensor module 1040, as a part or additional element, thus controlling the sensor module 1040 while the processor 1010 is in a sleep state.

The input device 1050 may include, for example, a touch panel 1052, a (digital) pen sensor 1054, a key 1056, or an ultrasonic input device 1058. The touch panel 1052 may recognize, for example, a touch input using at least one of a capacitive type, a resistive type, an infrared type, or an ultrasonic wave type. Additionally, the touch panel 1052 may further include a control circuit. The touch panel 1052 may further include a tactile layer to provide a tactile reaction for a user.

The (digital) pen sensor 1054 may be a part of the touch panel 1052, or may include a separate sheet for recognition. The key 1056, for example, may include a physical button, an optical key, or a keypad. The ultrasonic input device 1058 may detect an ultrasonic wave, which is generated from an input instrument, through a microphone 1088 to confirm data corresponding to the detected ultrasonic signal.

The display 1060 may include a panel 1062, a hologram device 1064, or a projector 1066. The panel 1062, for example, may be implemented to be flexible, transparent, or wearable. The panel 1062 and the touch panel 1052 may be implemented in one module. The hologram device 1064 may show a three-dimensional image in a space using interference of light. The projector 1066 may project light onto a screen to display an image. The screen, for example, may be positioned in the inside or outside of the electronic device 1001. According to an embodiment, the display 1060 may further include a control circuit for controlling the panel 1062, the hologram device 1064, or the projector 1066.

The interface 1070, for example, may include a high-definition multimedia interface (HDMI) 1072, a universal serial bus (USB) 1074, an optical interface 1076, or a D-sub (D-subminiature) 1078. Additionally or alternatively, the interface 1070, for example, may include a mobile high definition link (MHL) interface, an SD card/multi-media cared (MMC) interface, or an Infrared data association (IrDA) standard interface.

The audio module 1080 may convert a sound and an electric signal in dual directions. The audio module 1080, for example, may process sound information that is input or output through the speaker 1082, the receiver 1084, the earphone 1086, or the microphone 1088.

The camera module 1091 may be a unit which is capable of taking a still picture and a moving picture. The camera module 1091 may include one or more image sensors (e.g., a front sensor or a rear sensor), a lens, an image signal processor (ISP), or a flash (e.g., a light emitting diode (LED) or a xenon lamp).

The power management module 1095 may manage, for example, power of the electronic device 1001. The power management module 1095 may include, for example, a power management integrated circuit (PMIC) a charger integrated circuit (IC), or a battery gauge. The PMIC may operate in wired and/or wireless charging mode. A wireless charging mode may include, for example, diverse types of magnetic resonance, magnetic induction, or electromagnetic wave. For the wireless charging, an additional circuit, such as a coil loop circuit, a resonance circuit, or a rectifier, may be further included therein. The battery gauge, for example, may measure a remnant of the battery 1096, a voltage, a current, or a temperature during charging. The battery 896 may measure, for example, a residual, a voltage on charge, a current, or temperature thereof. The battery 1096 may include, for example, a rechargeable battery and/or a solar battery.

The indicator 1097 may display the following specific state of the electronic device 1001 or a part (e.g., the processor 1010) thereof: a booting state, a message state, or a charging state. The motor 1098 may convert an electric signal into mechanical vibration and generate a vibration or haptic effect. Although not shown, the electronic device 1001 may include a processing unit (e.g., a GPU) for supporting a mobile TV. The processing unit for supporting the mobile TV, for example, may process media data that is based on the standard of digital multimedia broadcasting (DMB), digital video broadcasting (DVB), or media flow (MediaFlo™).

Each of the above-described elements of the electronic device may be implemented using one or more components, and a name of a relevant component may vary with on the kind of the electronic device. The electronic device may include at least one of the above components. Also, a part of the components may be omitted, or additional other components may be further included. Also, some of the components of the electronic device may be combined to form one entity, thereby making it possible to perform the functions of the relevant components substantially the same as before the combination.

At least a part of an apparatus (e.g., modules or functions thereof) or a method (e.g., operations), for example, may be implemented by instructions stored in a non-transitory computer-readable storage medium in the form of a programmable module. The instruction, when executed by a processor (e.g., the processor 1010), may perform a function corresponding to the instruction. Such a non-transitory computer-readable medium may be, for example, the memory 1030.

The non-transitory computer-readable recording medium may include a hard disk, a magnetic media such as a floppy disk and a magnetic tape, an optical media such as compact disc ROM (CD-ROM) and a DVD, a magneto-optical media such as a floptical disk, and the following hardware devices specifically configured to store and perform a program instruction (e.g., a programming module): ROM, RAM, and a flash memory. Also, a program instruction may include not only a mechanical code such as things generated by a compiler but also a high-level language code executable on a computer using an interpreter. The above hardware unit may be configured to operate via one or more software modules for performing an operation of the present disclosure, and vice versa.

A module or a programming module may include at least one of the above elements, or a part of the above elements may be omitted, or additional other elements may be further included. Operations performed by a module, a programming module, or other elements may be executed sequentially, in parallel, repeatedly, or in a heuristic method. Also, a portion of operations may be executed in different sequences, omitted, or other operations may be added thereto.

It may be accomplishable, in an electronic device comprising a plurality of antennas, to secure isolation between the antennas and to optimize resonance for each antenna in a desired frequency band by connecting at least one matching block, which is connected with a ground area, with a side of at least one antenna radiator.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

What is claimed is:

1. An electronic device including a plurality of antennas, the electronic device comprising:

a first radiator supplied with power from a first feeding unit and connected with a ground area; and a second radiator supplied with power from a second feeding unit and connected with the ground area, wherein the first radiator is configured to be connected with at least one matching block that is connected with the ground area, the first radiator comprises: a first area directed away from the at least one matching block with respect to a point to which the first feeding unit of the first radiator is connected, the first area having a first antenna resonance length, and a second area directed to the at least one matching block with respect to the point to which the first feeding unit is connected, the second area having a second antenna resonance length, and the first radiator is configured to: transmit and receive a first frequency signal through the first antenna resonance length, and transmit and receive a second frequency signal through the second antenna resonance length, wherein the second radiator comprises a third area adjacent to the first radiator, the third area having a third antenna resonance length, and the second radiator is configured to transmit and receive a third frequency signal through the third antenna resonance length, and wherein the at least one matching block is connected with the second area of the first radiator adjacent to the second radiator.

2. The electronic device of claim 1, wherein the first antenna resonance length is configured to be formed by a resonant frequency formed by the at least one matching block.

3. The electronic device of claim 1, wherein the first frequency signal has a frequency that is lower than a frequency of the second frequency signal.

4. The electronic device of claim 1, wherein the first radiator forms a coupling in an area adjacent to the second radiator.

5. The electronic device of claim 1, wherein the at least one matching block is configured to be connected adjacent to a side of the first radiator.

6. The electronic device of claim 1, wherein the at least one matching block is configured to include at least one inductor and at least one capacitor in one of a serial configuration and a parallel configuration.

7. An electronic device with a metallic frame, the electronic device comprising:

a first segmented part and a second segmented part that divide at least an area of the metallic frame;

a first radiator disposed between the first segmented part and the second segmented part in the metallic frame and connected with a first feeding unit and a ground area;

a second radiator disposed left of the first segmented part in the metallic frame and connected with a second feeding unit and the ground area; and a third radiator disposed right of the second segmented part in the metallic frame and connected with a third feeding unit and the ground area, wherein the first radiator is configured to be connected with at least one matching block that is connected with the ground area, the first radiator comprises: a first area directed away from the at least one matching block with respect to a point to which the first feeding unit of the first radiator is connected, the first area having a first antenna resonance length, and a second area directed to the at least one matching block with respect to the point to which the first feeding unit is connected, the second area having a second antenna resonance length, wherein the second radiator comprises a third area adjacent to the first radiator, the third area having a third antenna resonance length, and wherein the at least one matching block is connected with the second area of the first radiator adjacent to the second radiator.

8. The electronic device of claim 7, wherein the first segmented part and the second segmented part are formed of an insulating material that electrically isolates the metallic frame.

9. The electronic device of claim 7, wherein the first radiator is configured to transmit and receive a first frequency signal through the first antenna resonance length, and to transmit and receive a second frequency signal through the second antenna resonance length, and wherein the second radiator is configured to transmit and receive a third frequency signal through the third antenna resonance length.

10. The electronic device of claim 9, wherein the first antenna resonance length is configured to be formed by a resonant frequency formed by the at least one matching block.

11. The electronic device of claim 9, wherein the third frequency signal has a frequency that is higher than a frequency of the first frequency signal and that is lower than a frequency of the second frequency signal.

12. The electronic device of claim 7, wherein the first radiator forms a coupling with the second radiator at the first segmented part, and forms a coupling with the third radiator at the second segmented part.

13. The electronic device of claim 7, wherein the at least one matching block is configured to include at least one inductor and at least one capacitor in one of a serial configuration and a parallel configuration.

14. A portable electronic device comprising:

a case member including a first surface, a second surface facing opposite to the first surface, and a side surrounding a space between the first surface and the second surface;

a first metallic member configured to one of form a part of the side of the case member and be formed adjacent to the part of the side of the case member;

a second metallic member configured to one of form another part of the side of the case member and be formed adjacent to the another part of the side of the case member, without contacting the first metallic member;

at least one wireless communication integrated circuit (IC) electrically connected with one of the first metallic member and the second metallic member;

a ground member disposed within the case member; and a filter circuit disposed adjacent to the second metallic member and electrically connected between a part of the first metallic member and the ground member, wherein the first metallic member comprises a first area directed away from the filter circuit with respect to a point to which the at least one wireless communication integrated circuit is connected, and a second area directed to the filter circuit with respect to the point to which the at least one wireless communication integrated circuit is connected, and wherein the filter circuit is connected with the second area of the first metallic member adjacent to the second metallic member.

15. The portable electronic device of claim 14, wherein the first metallic member is configured to form at least a part of a first antenna for wireless communication in a first frequency band.

16. The portable electronic device of claim 15, wherein the second metallic member is configured to form at least one of a second antenna for wireless communication in a second frequency band that is different from the first frequency band.

17. The portable electronic device of claim 16, wherein the filter circuit is configured to allow at least a portion of a signal having a frequency of the second frequency band to be passed.

18. The portable electronic device of claim 14, wherein the filter circuit is configured to include at least one inductor and at least one capacitor that are connected to each other in a parallel configuration or a serial configuration between a part of the first metallic member and the ground member.

19. The portable electronic device of claim 16, wherein the first frequency band includes frequencies that are selected from a range of 700 to 1000 MHz, and wherein the second frequency band includes frequencies selected from a range of 1400 to 3000 MHz.

20. The portable electronic device of claim 14, further comprising an insulating material that is disposed between the first metallic member and the second metallic member.

* * * * *